US005873347A

United States Patent [19]

Kato et al.

[11] Patent Number: 5,873,347

[45] Date of Patent: Feb. 23, 1999

[54] FUEL SUPPLY SYSTEM FOR AN ENGINE POWERING AN OUTBOARD MOTOR

[75] Inventors: Masahiko Kato; Hitoshi Motose, both of Hamamatsu, Japan

[73] Assignee: Sanshin Kogyo Kabushiki Kaisha, Hamamatsu, Japan

[21] Appl. No.: 958,812

[22] Filed: Oct. 28, 1997

[30] Foreign Application Priority Data

Oct. 28, 1996 [JP] Japan ..... 8-285138

[51] Int. Cl.[6] ..... F02M 37/04

[52] U.S. Cl. ..... 123/497; 123/510; 123/516

[58] Field of Search ..... 123/510, 511, 123/497, 516

[56] References Cited

U.S. PATENT DOCUMENTS

| | | | |
|---|---|---|---|
| 4,730,591 | 3/1988 | Gohara et al. | 123/510 |
| 4,926,829 | 5/1990 | Tuckey | 123/497 |
| 5,375,578 | 12/1994 | Kato et al. | 123/516 |
| 5,389,245 | 2/1995 | Jaeger et al. | 123/497 |
| 5,404,858 | 4/1995 | Kato | 123/516 |
| 5,579,740 | 12/1996 | Cotton et al. | 123/516 |
| 5,653,103 | 8/1997 | Katoh | 60/283 |
| 5,669,358 | 9/1997 | Osakabe | 123/509 |
| 5,724,936 | 3/1998 | Osakabe | 123/198 R |
| 5,743,239 | 4/1998 | Iwase | 123/497 |

*Primary Examiner*—Thomas N. Moulis
*Attorney, Agent, or Firm*—Knobbe, Martens, Olson & Bear LLP

[57] ABSTRACT

A fuel supply system for an engine powering an outboard motor is disclosed. The fuel supply system includes a first pump for delivering fuel from a fuel supply to a fuel reservoir located at the motor. Another pump delivers fuel from the reservoir to a charge former. The rate of fuel delivery into the reservoir is regulated by a valve based upon the level of the fuel within the reservoir. A flow rate sensor is provided for sensing the fuel flow rate into the reservoir. The fuel system is arranged to limit a change in sensed fuel flow rate when a position of the motor is changed, such as when the motor is trimmed.

16 Claims, 11 Drawing Sheets

FUEL SUPPLY SYSTEM FOR AN ENGINE POWERING AN OUTBOARD MOTOR

FIELD OF THE INVENTION

The present invention is a fuel supply system for an engine of the type useful in powering an outboard motor. More particularly, the invention is such a system arranged to limit the effect of a change in motor position upon a sensed fuel flow to the engine.

BACKGROUND OF THE INVENTION

Internal combustion engines which are used to propel outboard motors are generally positioned in a cowling of the motor. The engine is arranged to power a water propulsion device of the motor, such as a propeller.

Generally, the motor is connected to the watercraft in a manner which permits the motor to be "trimmed" up and down. For example, the motor may be connected to a clamping bracket attached to the watercraft by a horizontally extending pivot pin. In this manner, the motor may be moved in a vertical plane about the axis of the pin. This allows an operator of the craft to raise the propeller out of the water or place it deep in the water dependent upon the trim angle of the motor.

Changing the trim angle of the motor may have a significant impact upon the operating conditions of the engine. For example, the fuel supply system for the engine may include a fuel reservoir mounted in the cowling of the motor to which fuel is delivered from a main fuel tank in the watercraft. A pump is provided for pumping fuel from the main fuel tank to the motor mounted reservoir. The pumping rate of this pump may be based upon the fuel level in the motor mounted fuel reservoir.

This arrangement may work satisfactory when the motor is oriented in its normal operating condition. When, however, the motor is trimmed, the fuel in the motor mounted fuel reservoir shifts. This shifting causes the reservoir to appear less or more full than it actually is, and resulting in a pump control causing the delivery pump to erroneously deliver fuel thereto at an excessively low or high rate.

A fuel supply system for such an engine arranged to overcome the above-stated problems is desired.

SUMMARY OF THE INVENTION

In accordance with the present invention, there is provided a fuel supply system for an engine of the type used to power an outboard motor. The outboard motor is of the type which preferably includes a water propulsion device, and is pivotally connected to a watercraft, whereby a position of the motor may be changed.

The engine has an output shaft in driving relation with the water propulsion device. The engine also has at least one combustion chamber and an intake system for providing air to the combustion chamber.

The fuel supply system includes pump means for delivering fuel from a fuel supply to a motor mounted fuel reservoir, means for delivering fuel from the reservoir to a charge former for delivering fuel to the combustion chamber, valve means for controlling the flow of fuel into the reservoir based on a fuel level within the reservoir, fuel flow rate detection means for detecting a flow rate of fuel into the reservoir, control means for controlling the pump means based upon a detected flow rate, and means for limiting a change in sensed fuel flow rate when a position of the motor is changed.

In preferred embodiment, the fuel reservoir comprises a vapor separator.

In accordance with one embodiment of the invention, the means for limiting comprises means for limiting a change in fuel level in the reservoir when the position of the motor changes, such as a baffle positioned in the reservoir.

In another embodiment of the invention, the valve means comprises a float operated valve controlling a fuel inlet to the reservoir and the means for limiting comprises arranging the reservoir so that a fuel level in the reservoir generally passes through a center of gravity of the float regardless of a position of the motor.

In yet another embodiment of the present invention, the means for limiting comprises means for limiting a change in a sensed fuel flow rate when the motor position is changed from a sensed flow rate before said motor position is changed. In one arrangement of this embodiment, this means for limiting a change prevents the sensed flow rate from increasing more than about twenty percent above, and prevents the sensed flow rate from decreasing more than about twenty-five percent below, the sensed flow rate before the motor position is changed.

In another embodiment of the present invention, the means for limiting comprises means for increasing a sensing interval of the fuel flow rate detection means when a position of the motor is changed.

Advantageously, the fuel system of the present invention is arranged so that a changed in outboard motor position, such as when the motor is trimmed, does not permit an excessive increase or decrease in fuel flow rate as indicated by the fuel flow sensor.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In general, the present invention is a fuel supply system for an internal combustion engine. The system is of the preferably of the type in which lubricant is supplied into the fuel system, whereby a combination of fuel and lubricant is supplied to at least a portion of the fuel system. As used herein it is understood that the terms "oil" and "lubricant" are generally interchangeable, and may mean the naturally occurring mineral, a man-made synthetic material, or mixtures thereof.

Figure 1:
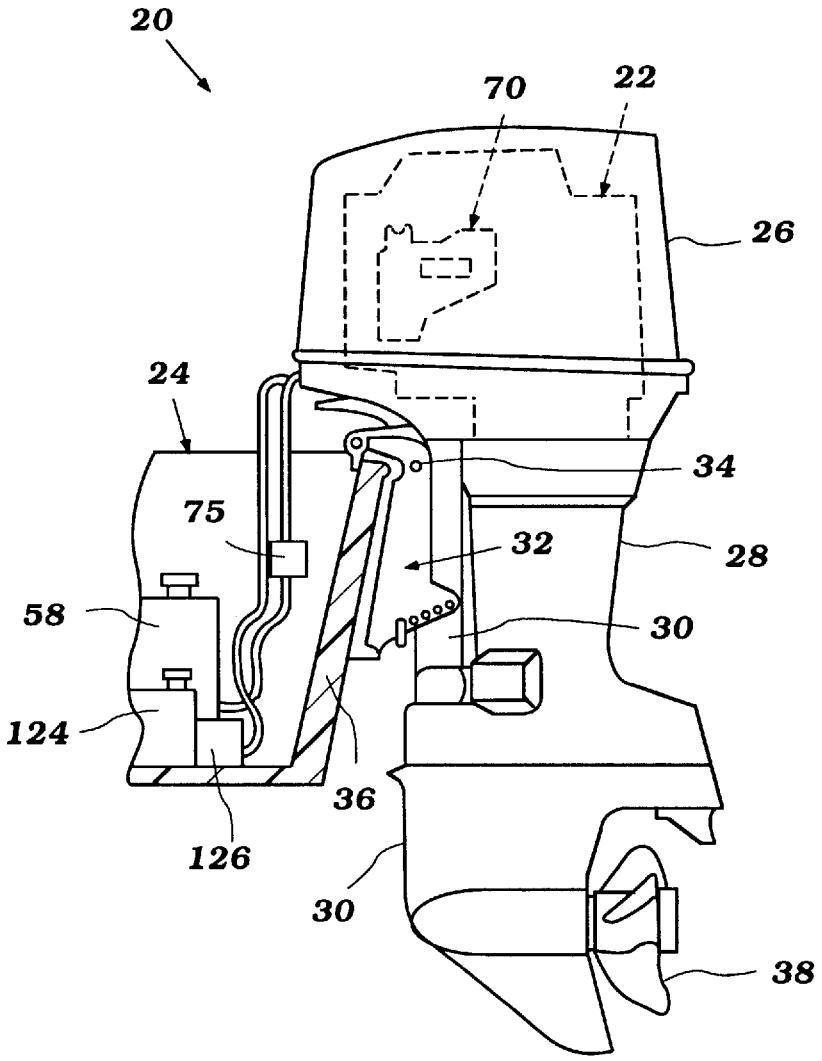
FIG. 1 illustrates a watercraft, in cross-section, propelled by an outboard motor powered by an engine having a fuel supply system in accordance with the present invention.

Referring to FIG. 1, the engine 20 is preferably utilized to power an outboard motor 22 for propelling a watercraft 24. The fuel supply system of the present invention is described for use with an outboard motor 20 since this is a specific application with which the system of the present invention has particular benefits. One skilled in the art will appreciate, however, that the fuel supply system of the present invention may be used with engines used in other applications.

The outboard motor 20 may be of a variety of types and arrangements. As illustrated, the motor 20 has a cowling 26 in which the engine 22 is positioned. A lower unit 28 depends below the cowling 26. The lower unit 28 is preferably defined by a casing 30.

The motor 20 is movably connected to the watercraft 24. A vertically extending steering shaft (not shown) is connected to the motor 20 and positioned within a steering or swivel bracket 30, allowing the motor 20 to be moved left or right about a vertically extending axis for steering the watercraft 24. In addition, the swivel bracket 30 is rotatably connected to a clamping bracket 32 via a horizontally extending pin 34, permitting rotation of the motor 20 in a vertical plane about the pin 34. The clamping bracket 32 is connected to a hull 36 of the watercraft 24 at a rear or transom portion thereof. The pivotal connection of the motor 20 to the watercraft 24 about the pin 34 permits the motor to be "trimmed," or raised and lowered in a vertical plane from a raised position to a lowered position.

The motor 20 includes means for propelling water. Preferably, this means comprises a propeller 38. The engine 22 has a crankshaft 39 (see FIG. 2) arranged to drive a drive shaft (not shown) which extends through the lower unit 28 in driving relation with the propeller 38. In this manner, the engine 22 drives the propeller 38, propelling the watercraft 24. The drive shaft is preferably arranged to drive the propeller 38 through a transmission, such as a forward-neutral-reverse transmission as known to those skilled in the art.

Figure 2:
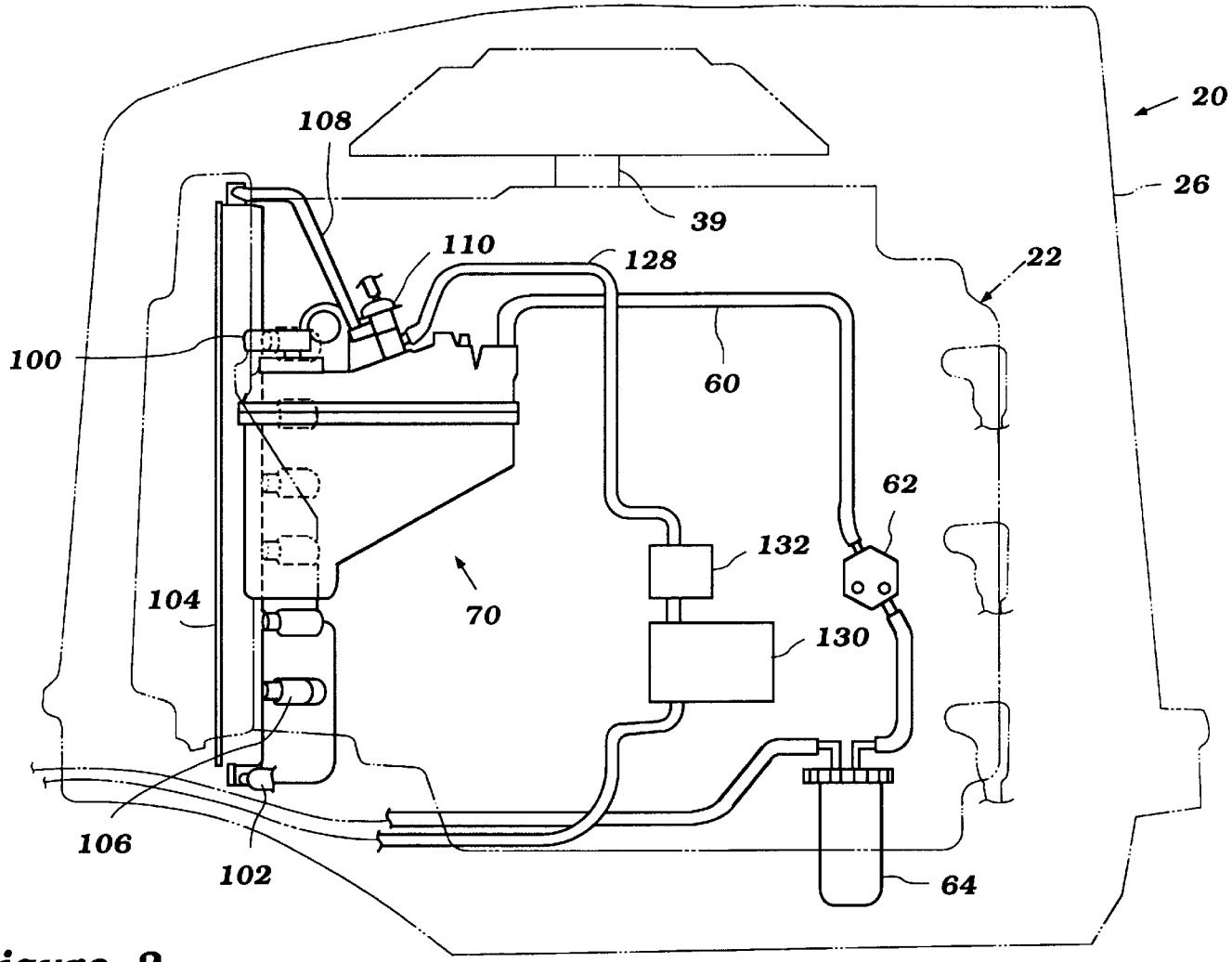
FIG. 2 is a side view of the engine illustrated in FIG. 1, with a cowling of the motor surrounding the engine in phantom, illustrating a fuel supply system in accordance with the first embodiment.
Figure 3:
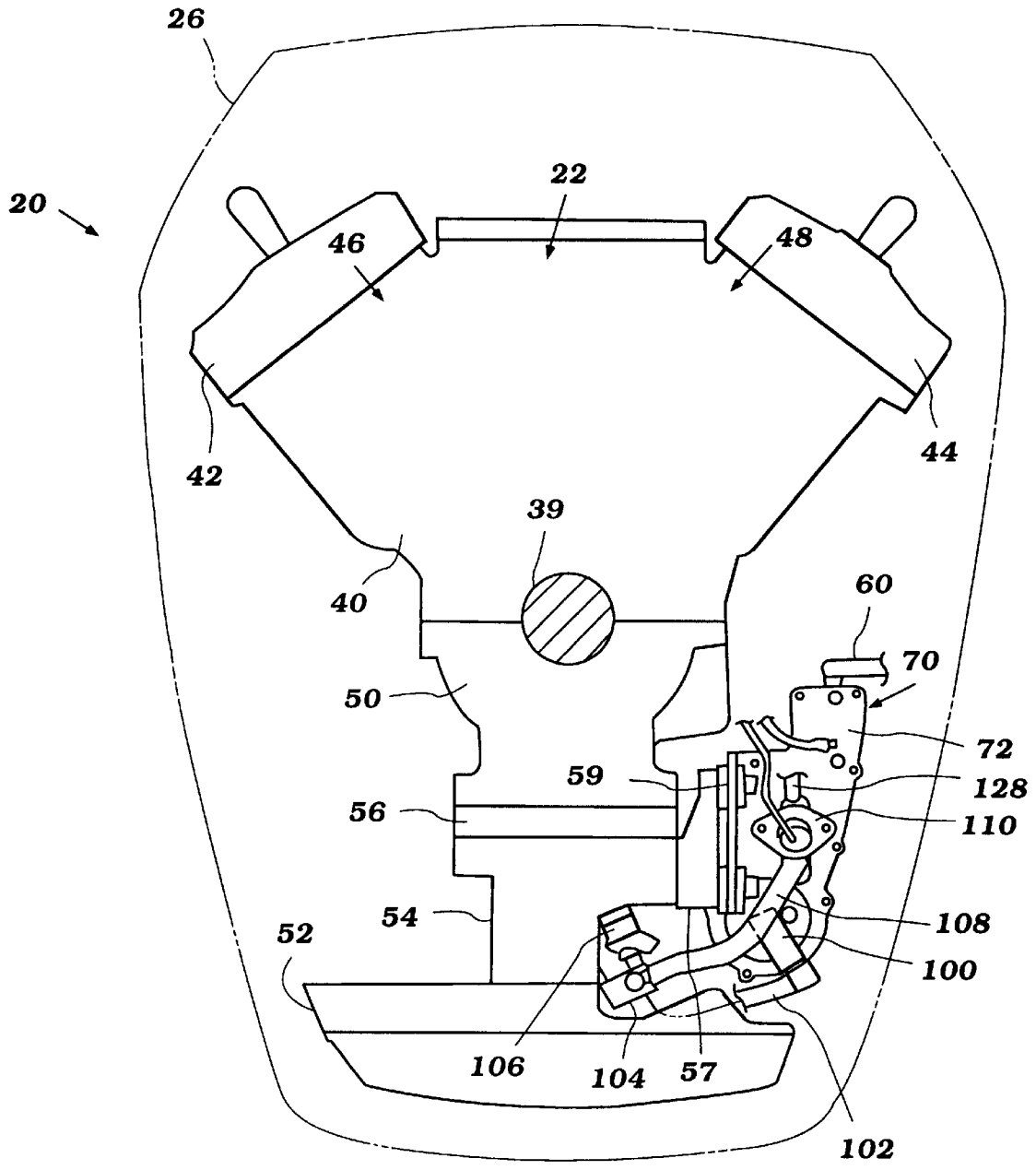
FIG. 3 is a top view of the engine having the fuel supply system illustrated in FIG. 2.

The engine 22 is best illustrated in FIGS. 1–3. As illustrated, the engine 22 is of the "V"-type, having a cylinder block 40 with first and second cylinder heads 42,44 connected thereto and cooperating therewith to define first and second cylinder banks 46,48. Each bank 46,48 preferably contains at least one combustion chamber or cylinder in which combustion occurs. Of course, each bank 46,48 may contain more than one cylinder, such as three in a "V-6" type engine.

A piston (not shown) or other element is preferably movably mounted in each cylinder of the engine 22 and connected to the crankshaft 39. As illustrated, the engine 22 is arranged so that the crankshaft 39 is generally vertically extending.

The engine 22 illustrated is of the two-cycle crankcase compression variety. It is contemplated that the engine 22 with which the fuel and lubricant supply system of the present invention is used be of the four-cycle, rotary or other type. In addition, the engine 22 may be arranged in other than "V" fashion, such as in-line or opposed as known to those skilled in the art.

Because the engine 22 is of the two-cycle variety, it includes a crankcase compression area. As illustrated, a crankcase member 50 is connected to the cylinder block 40 generally opposite the cylinder heads 42,44. The crankcase member 50 is arranged to cooperate with the cylinder block 40 to define a crankcase chamber corresponding to each cylinder or combustion chamber of the engine 22.

An intake system is provided for routing air into each crankcase chamber. Preferably, the intake system includes a silencer 52 into which air within the cowling 30 is drawn. Preferably, a vent (not shown) is provided in the cowling 30 for permitting outside air to be drawn into the space therein. The air then passes through an intake manifold 54 and through a valve body 56 into the crankcase chambers. As illustrated, the valve body 56 is positioned between the manifold 54 and the crankcase member 50, the manifold 54 connected to the crankcase member 50.

The intake manifold 54 preferably includes a passage therethrough corresponding to each combustion chamber of the engine 22. Each passage through the manifold 54 leads to a reed valve (not shown) of the valve body 56. The reed valve controls the flow of air from the intake manifold 54 to the crankcase chamber.

As described in greater detail below, fuel is added to the air passing through the manifold 54, whereby a combined air and fuel charge is supplied to each crankcase chamber. In particular, and as well known in the two-cycle engine art, the reed valve permits the flow of an air and fuel charge into the chamber corresponding to a cylinder as the piston moves upwardly. As the piston moves downwardly, the charge is partially compressed and then drawn into the cylinder through a scavenge passage (not shown). The charge is then combusted, forcing the piston back downwardly. The combustion products are then routed from the cylinder through an appropriate exhaust system (not shown) as known to those skilled in the art.

A fuel supply system provides fuel to the engine 22. Referring to FIGS. 1 and 2, fuel is drawn from a fuel supply. The fuel supply preferably comprises a fuel tank 58 located in the hull 36 of the watercraft 24. Fuel is drawn from the tank 58 through a delivery line 60 by a fuel pump 62. The fuel pump 62 is preferably of the low pressure variety, and positioned near the engine 22 within the cowling 26 of the motor 20. A fuel filter 64 is positioned along the delivery line 60 for filtering the fuel.

Figure 4:
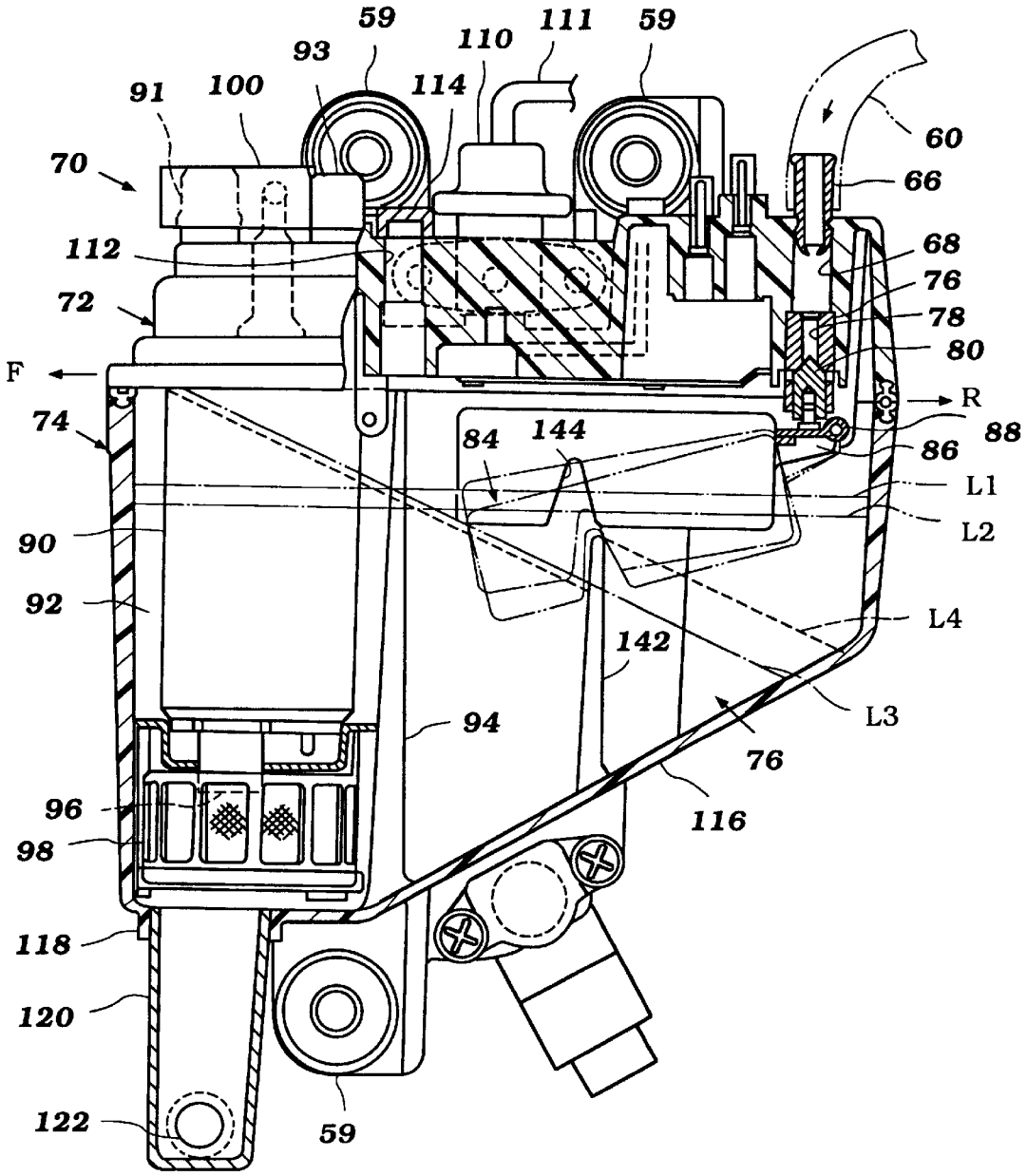
FIG. 4 is a cross-sectional view of a vapor separator of the fuel supply system in accordance with the first embodiment of the present invention.

The delivery line 60 leads to a reservoir, such as a vapor separator 70, also positioned within the cowling 26 and connected to the engine 22. Preferably, the separator 70 is connected to the engine 22 via a mounting bracket 57 extending from the manifold 54. Bolts or similar fasteners engage the bracket 57 and one or more mounts 59 of the separator 70 to couple them together. Referring to FIG. 4, the line 60, which preferably comprises flexible tubing or hose, is connected to a fitting 66 extending from an inlet port 68. The inlet port 68 comprises a passage through a lid 72 of the separator 70. The lid 72 is connected to a body 74 of the separator 70 and cooperates therewith to define an internal chamber 76.

The fuel is delivered into the chamber 76 through the port 68 as controlled by a control valve. This valve is preferably of the float type, in which the position of the valve is dependent upon a fuel level within the separator 70. The valve preferably includes a sleeve 78 having a restricted passage 80 therethrough and a needle 82 for selective positioning in obstruction of the passage 80. The needle 82 is actuated by a fuel float 84. The float 84 is connected to one end of an arm 86, the opposite arm 86 pivotally connected to the body 74 of the separator 70 by a pin 88.

When the fuel level within the separator 70 becomes high, such as level L1 in FIG. 4, then the float 84 rises upwardly, forcing the needle 80 into the passage 78. In this position, the needle 80 blocks the passage 78 and prevents the entry of fuel into the separator 70. When the fuel level falls, such as to level L2 in FIG. 4, the float 84 sinks, pulling the needle 80 from the passage 78 and permitting fuel to flow into separator 70.

A fuel supply sensor 75 is provided along the line 60 for monitoring or sensing the flow rate through the line 60. Fuel flow rate data from the sensor 75 is used by a controller, such as an ECU, to control the fuel supply rate, such as by changing the amount time the pump 62 runs or its speed. Preferably, the ECU is arranged to compare an actual fuel consumption rate against the sensed fuel flow rate to control the pump 62. For example, when the fuel consumption rate of the engine 22 is high, the ECU compares this rate against the sensed flow rate through the line 60. If the flow rate is less than the actual consumption rate, then it is determined that the pump 62 output should be increased to supply a greater amount of fuel. On the other hand, if the engine fuel consumption rate diminishes, the controller is arranged to decrease the pump 62 rate or time to decrease the rate at which fuel is supplied to the delivery line 60 if the sensed fuel flow rate is greater than this actual rate of consumption. Though not illustrated, the sensed fuel flow rate may be displayed by a meter, gauge or the like.

Fuel is drawn from the separator 70 and delivered to one or more charge formers for delivery into the air passing through the intake manifold 54. As illustrated in FIG. 4, a high pressure fuel pump 90 is positioned within a pumping chamber 92 defined within the separator 70 by the body 74 and a wall 94. The pump 90 has an intake 96 positioned within a filter element 98. The pump 90 is preferably electrically operated and draws fuel from the chamber 76 through the filter 98.

The pump 90 is preferably electrically operated, and has a pair of contacts 91,93 to which are connected electrical leads for use in powering the pump 90.

The pump 90 expels fuel through a outlet pipe 100 leading to a high pressure line 102. The line 102 extends to a fuel rail 104. As illustrated, the rail 104 extends generally vertically along the end of the engine 22 near the silencer 52. Fuel under high pressure is delivered from the rail 104 to a charge former 106 corresponding to each combustion chamber or cylinder. As illustrated, the charge formers 106 comprise fuel injectors having their delivery ends positioned in the passages through the intake manifold 54.

A return line 108 extends from the end of the fuel rail 104 opposite the connection of the high pressure line 102. The return line 108 extends to a pressure regulator and return valve 110. The valve 110 is arranged to maintain the fuel pressure within the rail 104 at a high pressure, and yet permit the return of fuel which is delivered to the rail 104 but not delivered by the charge formers back to the separator 70.

A low pressure line 111 preferably extends from one of the intake passages to the valve 110 and is arranged to open the valve 110 at a pressure dependent upon the pressure in the intake passage. In this manner, the pressure within the fuel rail 104 is continually varied.

The returned fuel is preferably routed through the valve 110 to a passage 112 extending through the lid 72 of the separator 70. A plug 114 is preferably positioned in a top end of the passage 112 to prevent the leakage of fuel.

As also illustrated in FIG. 4, a bottom wall 116 of the separator 70 preferably includes a passage 118 therethrough positioned below the pump 90. A reservoir element 120 is connected to the separator 70 and defines a chamber in communication with the passage 118. Water in the fuel sinks to this low point below the bottom wall 116 of the separator 70. A drain line 122 is preferably provided for emptying the water from this chamber.

Referring again to FIGS. 1 and 2, lubricant is preferably supplied for mixing with the fuel for delivery as an oil and fuel mixture to the charge formers 106. Preferably, an oil supply, such as a tank 124 of oil, is provided in the hull 36 of the watercraft 24. A pump 126, preferably positioned near the tank 124, delivers oil from the tank through a delivery line 128. This line 128 extends into the cowling 26 of the motor 20 to a filter 130. The line 128 extends to another pump 132 for drawing the lubricant from the filter 130 and on to the fuel system.

As illustrated in FIG. 2, the line 128 extends to the return valve 110, where the lubricant is delivered into the fuel being returned from the fuel rail 104 for mixing therewith. This mixture is then delivered in to the separator 70 through the passage 112. This mixture mixes with the incoming fuel from the line 60, and is then drawn by the pump 90 and delivered to the charge formers 106.

Figure 5:
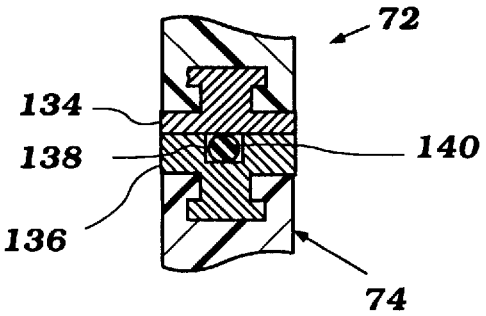
FIG. 5 is an enlarged partial cross-sectional view of a lid/body interface of the vapor separator illustrated in FIG. 4.
Figure 6:
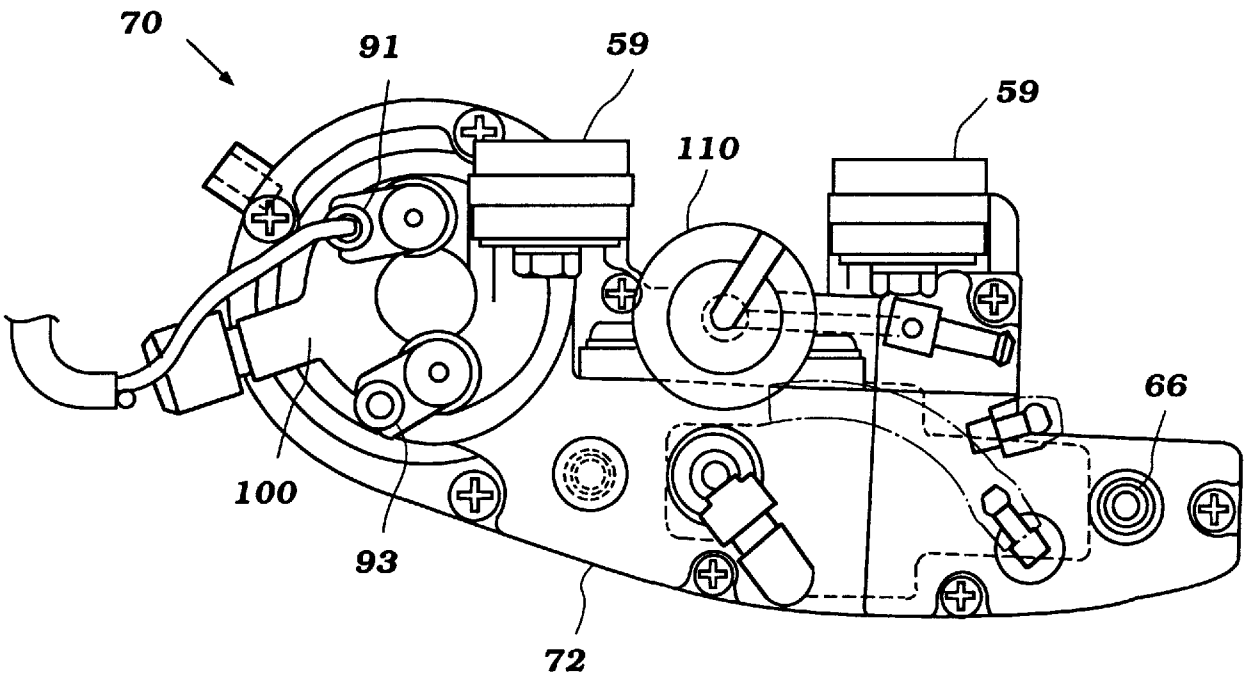
FIG. 6 is a top view of the vapor separator illustrated in FIG. 4.

FIG. 5 illustrates the connection of the lid 72 to the body 74 of the separator 70. As illustrated, a seal 134 is provided at a lower surface of the lid 72. A corresponding seal 136 is provided at a top surface of the body 74. A groove 138 is provided in the seal 136 corresponding to the body 74. An "O"-ring 140 is provided in the groove 138. The "O"-ring 140 cooperates with the seals 134,136 to provide a tight seal between the lid 72 and body 74 to prevent the leakage of fuel and lubricant from the chamber 76.

Means are preferably provided for limiting a change in sensed fuel flow rate caused by a change in position of the separator 70 when the trim position of the motor 20 is changed. As discussed above in the Background, when the motor 20 is trimmed "up" (i.e. the top portion of the motor 20 rotates towards the watercraft 24 about the pin 34), the vapor separator 70 is tilted in the direction F in FIG. 4, whereas when the motor is trimmed from its up to its down position, the separator 70 moves in the direction R. When the motor 20 is moved to its trim "up" position, the fuel in the separator 70 flows to a level L3 which generally causes the float 84 to move to a position in which the passage 78 is open, thus allowing fuel to flow therethrough at a high rate.

When this occurs, the sensed flow rate increases greatly, and the ECU controls the pump 62 based a comparison of this greatly changed flow rate to the actual consumption rate. This may cause the ECU to shut off the pump 62 or the like, eventually leading to a fuel shortage or other problems.

In the accordance with the first embodiment of the invention, the means for limiting comprises means for limiting the movement of the fuel within the separator 70 when the motor 20 is tilted. As illustrated, this means comprises at least one wall or baffle 142. The baffle 142 preferably extends upwardly from a bottom surface 116 of the separator 70 towards the float 84. Preferably, the float 84 as a cut-out or recessed area 144 for accommodating the top of the baffle 142 when it sinks towards the bottom 116 of the separator 70.

This baffle 142 serves to retain a portion of the fuel within the separator 70 at a higher level L4 even when the separator 70 is tilted. At this higher level, the float 84 is generally retained in the same position as if the separator 70 were not tilted, thus maintaining the needle 80 in the same position. Thus, the fuel flow rate does not appear (to the sensor 75) to increase simply as a result of the motor 20 being trimmed upwardly. In addition, this same arrangement prevents a corresponding decrease in sensed fuel rate when the motor 20 is trimmed to its down position.

Figure 7:
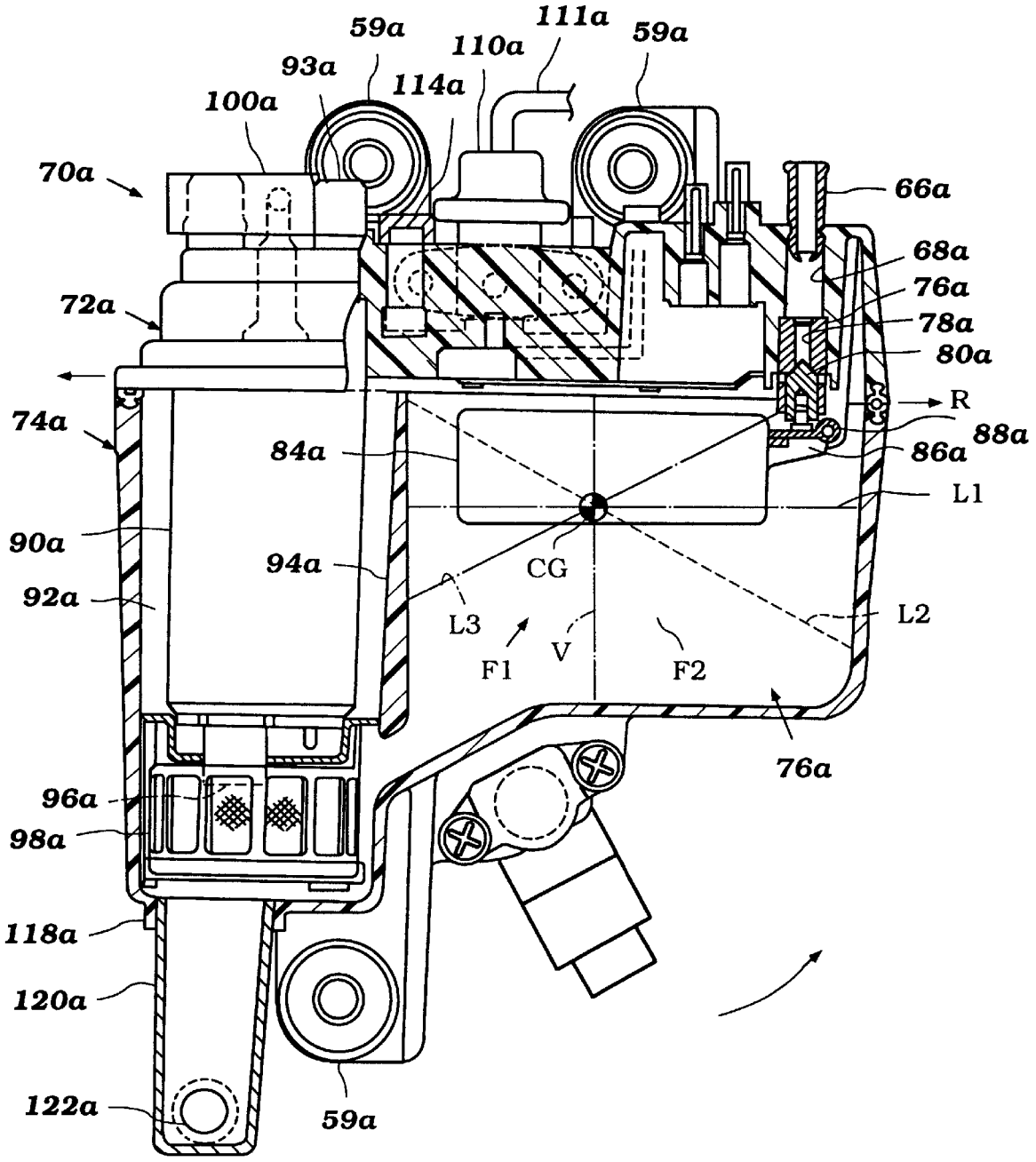
FIG. 7 is a cross-sectional view of a vapor separator of a fuel supply system in accordance with a second embodiment of the present invention.

FIG. 7 illustrates a vapor separator 70*a* of a fuel and lubricant supply system in accordance with a second embodiment of the present invention. In the illustration and description of this embodiment, like reference numerals have been used with similar parts to those used in describing and illustrating the first embodiment, except that an "a" designator has been added to all reference numerals.

As illustrated, the float 84*a* has a center of gravity CG. The separator 70*a* is arranged to that the chamber 76*a* defined therein by the body 74*a* and wall 94*a* is of a volume such that regardless of the position of the separator 70*a*, the fuel top surface passes through or nearly through the center of gravity CG of the float 84*a*. As illustrated, the float 84*a* is mounted so that its center of gravity CG is positioned along a vertical line V dividing the chamber 76*a* into roughly two equal halves which contain an equal amount of fluid F1/F2. When the separator 70*a* is level, the fuel level L1 passes through the center of gravity, as it does when the separator 70*a* is tilted with the motor forward or reverse (so that the fuel level is L2 or L3).

In accordance with this embodiment of the present invention, regardless of the position of the separator 70*a*, the float 84*a* remains in the same position since the fuel level always passes through or nearly through its center of gravity CG. Thus, the sensed fuel flow rate does not change substantially simply because the trim position of the motor 20 is changed.

Figure 8:
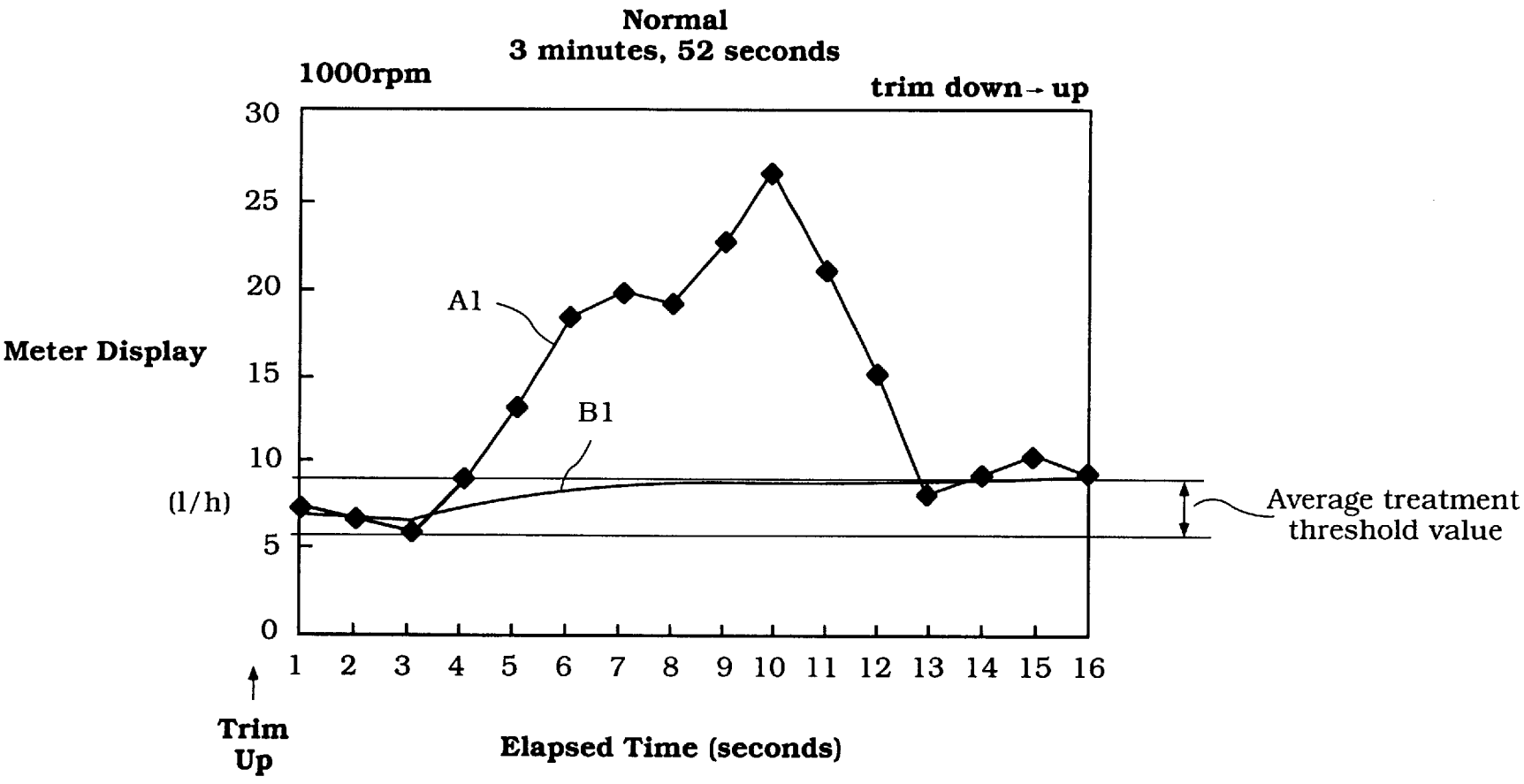
FIG. 8 is a graph illustrating sensed fuel flow versus time to trim an outboard motor from a down to up position in accordance with the prior art and in accordance with a fuel supply system in accordance with a third embodiment of the present invention.
Figure 9:
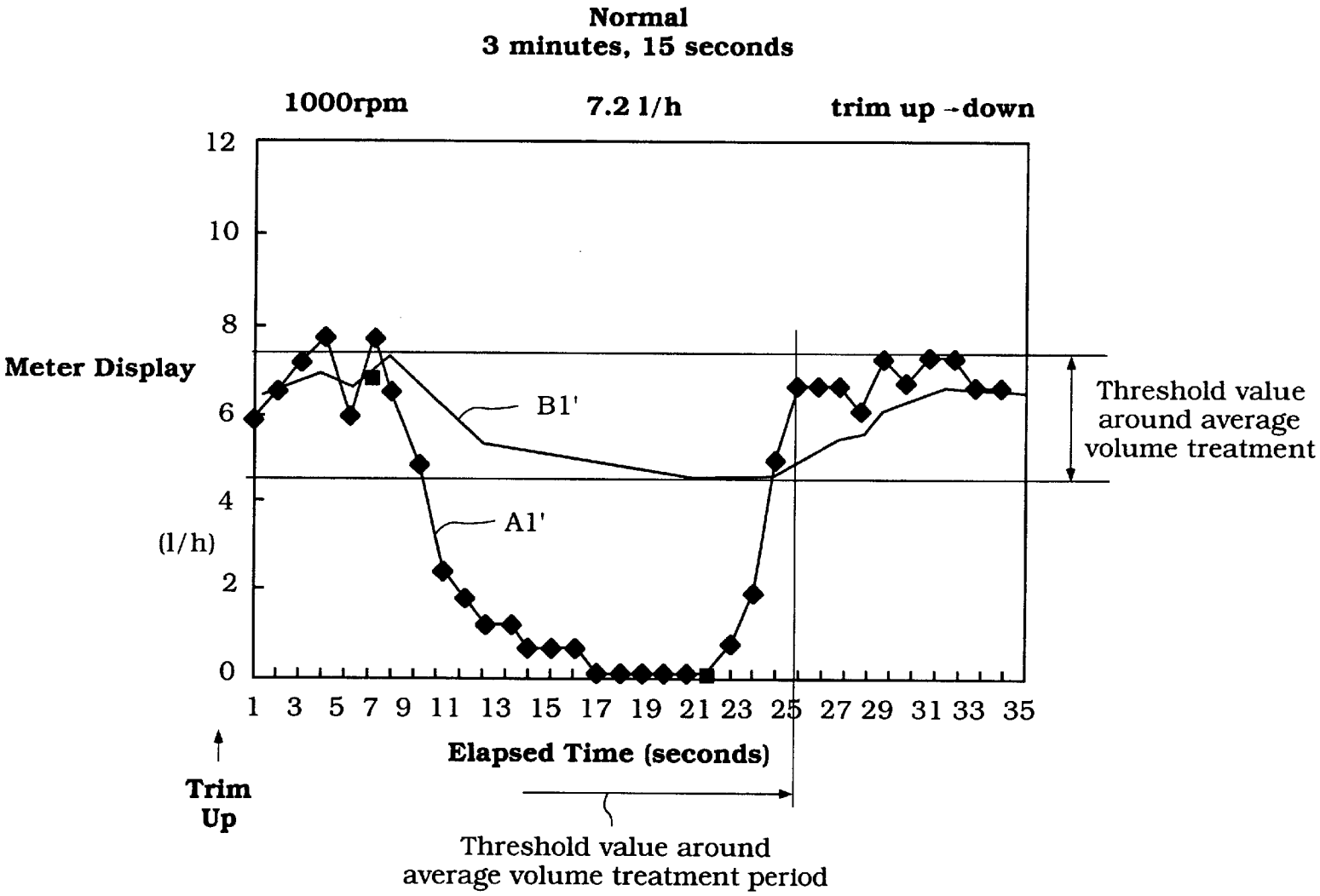
FIG. 9 is a graph illustrating sensed fuel flow versus time to trim an outboard motor from an up to a down position in accordance with the prior art and in accordance with the fuel supply system in accordance with the third embodiment of the present invention.

FIGS. 8 and 9 illustrate a fuel supply system in accordance with a third embodiment of the present invention. In accordance with this embodiment of the present invention, a control is provided for controlling a fuel supply system such as that described above without the means for limiting described therewith.

In particular, the fuel flow rate sensor or its control, such an ECU, is arranged to control the fuel flow sensor output in accordance with the following control strategy. In this embodiment, when a motor trim up or trim down procedure is started, the fuel flow sensor output is limited to a threshold about an average value. In this manner, the change is sensed flow rate is limited and the sensed flow rate does not change erroneously based upon the change in motor position.

A specific example of the system is illustrated in FIGS. 8 and 9. As illustrated in FIG. 8, when the engine powering the motor is operating at 1000 rpm, the time to trim the motor from a down to up position is about 3 minutes 52 seconds. At the beginning of the trim procedure, the average fuel flow as sensed by the fuel flow sensor is about 7.2 litters per hour (as indicated by a flow sensor output meter). When the motor trim procedure begins, the float in the separator moves, thus opening the fuel delivery port in a manner described above. In the prior art, the opening of the delivery port would cause an increased fuel flow rate, as indicated by the line A1 in FIG. 8.

In accordance with the present invention, however, the control limits the maximum change in flow rate output per sensed interval to about a 20% change (the sensor sensing interval is one second in the embodiment illustrated) and so that the maximum change over time is prevented from increasing to above about 20% of the sensed fuel flow rate before the trim procedure began. Thus, the controlled sensed fuel flow rate follows the curve B1, with the pump being controlled to deliver the rate of fuel based in part by this controlled rate.

FIG. 9 illustrates use of a fuel supply controlled in accordance with this embodiment of the invention when the motor is trimmed from up to down. As indicated in this example, when the motor moves, the valve controlling the flow of fuel to the reservoir closes, changing the sensed rate (as indicated by curve A1') generally to 0. In accordance with this embodiment of the invention, however, the rate of decrease in the sensed fuel flow rate is preferably limited to about a 25% change per sensed interval and prevented from decreasing below about 25% of the fuel flow rate before the trim procedure. In that instance, the controlled sensed flow rate is indicated by curve B1'.

Preferably, the control strategy of this embodiment is employed for a certain time duration after the initiation of the motor position change. For example, as illustrated in FIG. 8, the control procedure is employed for approximately 14–15 seconds after the trim down to up procedure is initiated (as indicated, for example, by the pushing of a trim switch). As illustrated in FIG. 9, the control procedure is employed for approximately 25 seconds after the initiation of a trim up to down procedure.

Of course, the amount by which the output is limited may be other than 20 or 25%.

Figure 10:
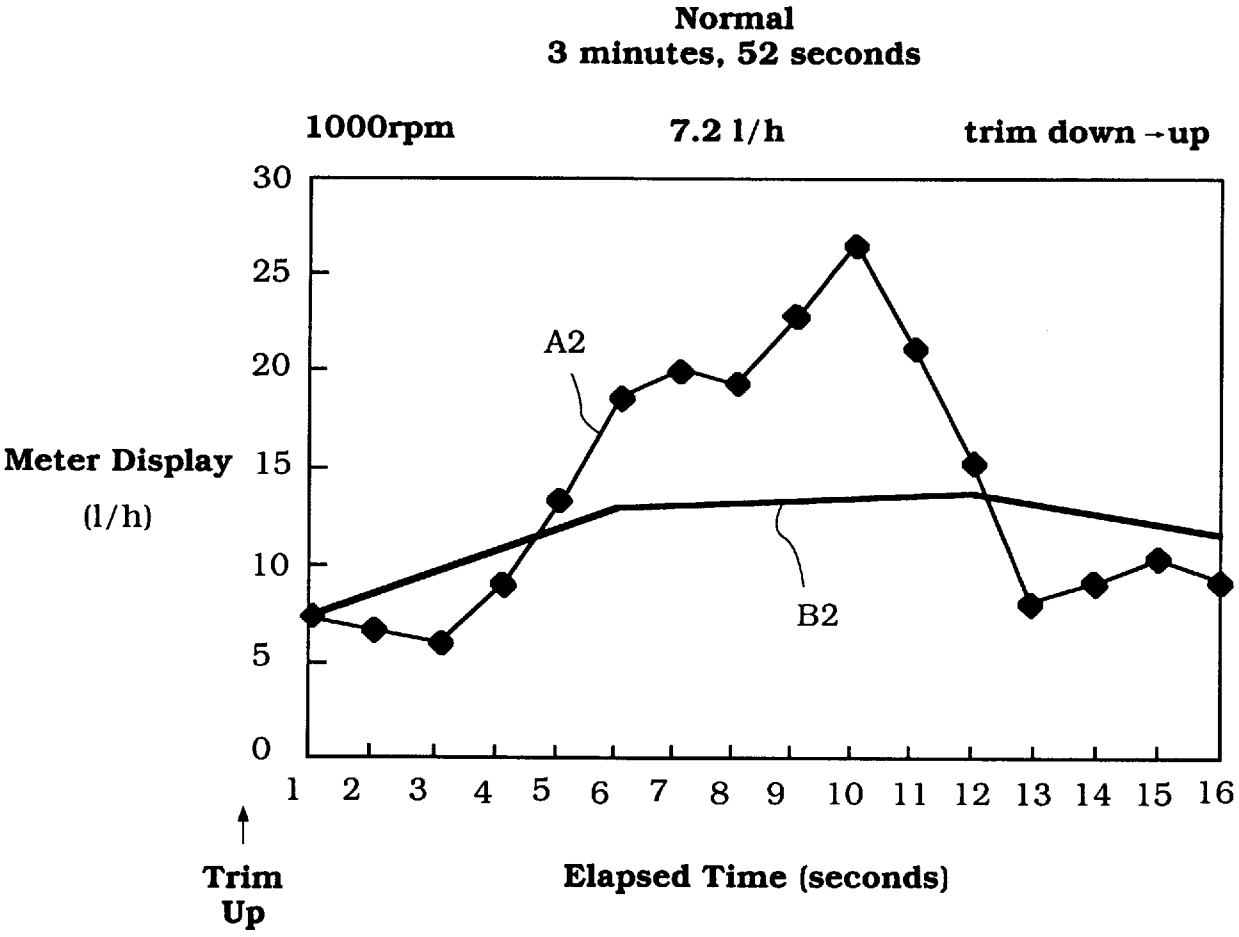
FIG. 10 is a graph illustrating sensed fuel flow versus time to trim an outboard motor from a down to up position in accordance with the prior art and in accordance with a fuel supply system in accordance with a fourth embodiment of the present invention.
Figure 11:
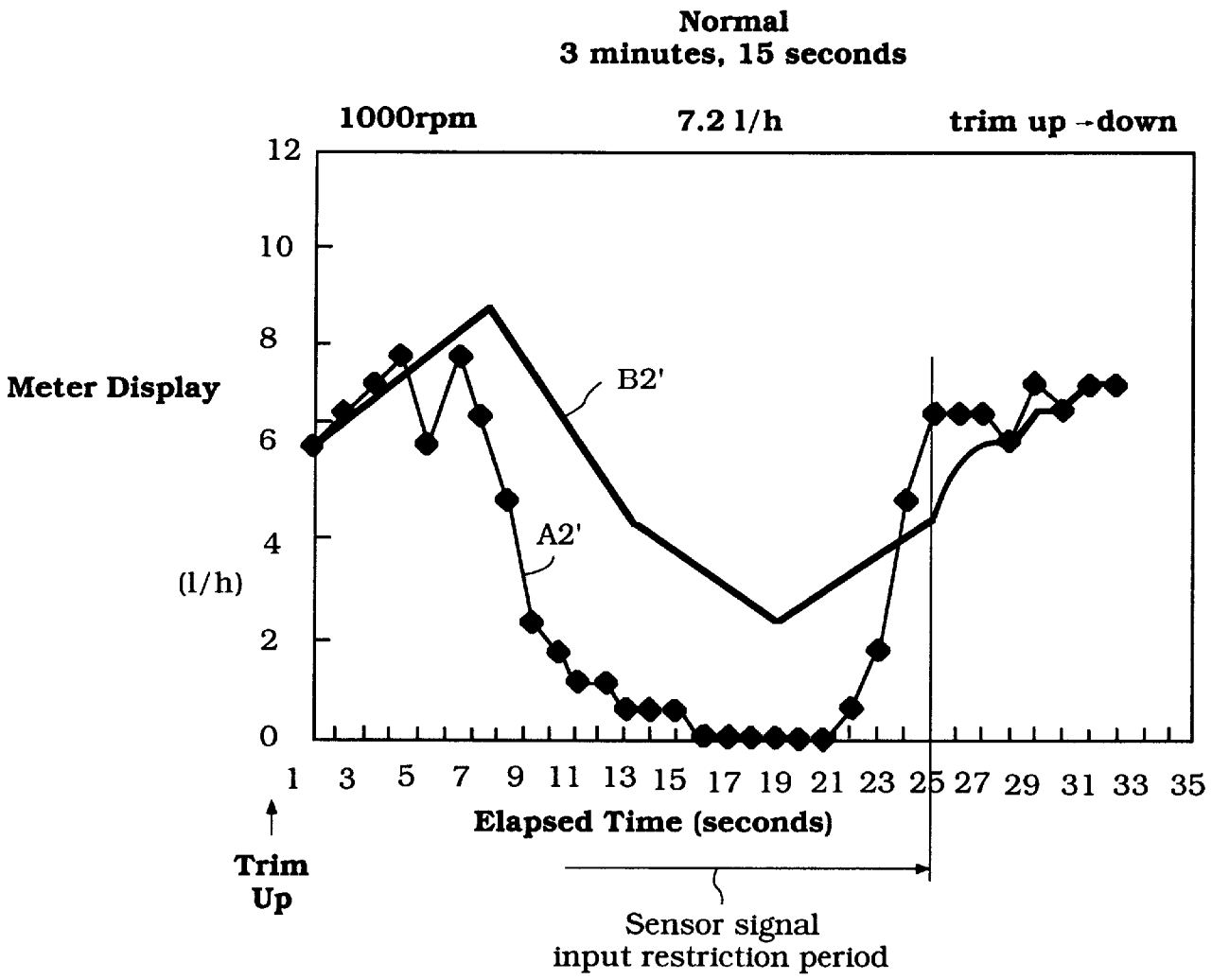
FIG. 11 is a graph illustrating sensed fuel flow versus time to trim an outboard motor from a down to up position in accordance with the prior art and in accordance with the fuel supply system of the fourth embodiment of the present invention.

FIGS. 10 and 11 illustrate a fuel supply in accordance with a fourth embodiment of the present invention. This embodiment fuel supply is generally similar to that described above in conjunction with FIGS. 8 and 9 in which a control is provided.

In this embodiment of the invention, the detected fuel flow volume is not limited in the manner of the control described above. Instead, when the trim procedure begins, the control is arranged to only obtain fuel flow data at greatly spaced intervals and indicates an averaged rate between the sensed intervals. In this manner, the rate that the detected flow rate changes is reduced.

FIG. 10 illustrates, by line A2, the change in sensed fuel flow rate when a motor having a fuel system without the means for limiting in accordance with the present invention is trimmed from its down to its up position. Line B2 illustrates the sensed fuel flow rate of the system of the fourth embodiment of the present invention.

In accordance with the present invention, the sensor's sensing interval is a first interval (such as one second) when the motor position is not being changed, and is a second longer interval (six seconds) when the motor position is being changed. Preferably, this second interval is used during a time period after the initiation of the trim procedure, such as during the first 14–15 seconds after the initiation of a trim down to up procedure and 25 seconds after the initiation of a trim up to down procedure.

Preferably, an average sensed value is used during the time between the spaced sensing intervals. The exact sensing interval may be greater than or less than the six second interval described, as long as it is greater than the interval used when the motor position is not being changed.

FIG. 11 illustrates the sensed fuel flow rate for a system without the means for limiting in accordance with the present invention (line A2') and that of this embodiment of the invention (line B2') when a motor is being trimmed from its up to its down position. Again, in this Figure, the control has been arranged to change the sensed fuel flow sensing interval from approximately 1 second when the motor is not being moved, to every 6 seconds after the motor trim procedure is started.

Of course, the foregoing description is that of preferred embodiments of the invention, and various changes and modifications may be made without departing from the spirit and scope of the invention, as defined by the appended claims.

What is claimed is:

1. A fuel supply system for an engine powering an outboard motor, said outboard motor including a water propulsion device and said engine having an output shaft in driving relation with said water propulsion device, said engine having at least one combustion chamber and an intake system for providing air to said combustion chamber, said fuel supply system including pump means for delivering fuel from a fuel supply to a motor mounted fuel reservoir, means for delivering fuel from said reservoir to a charge former for delivering fuel to said combustion chamber, valve means for controlling the flow of fuel into said reservoir based on a fuel level within said reservoir, fuel flow rate detection means for detecting a flow rate of fuel into said reservoir, control means for controlling said pump means based at least in part upon a sensed flow rate, and means for limiting a change in sensed fuel flow rate when a position of said motor is changed.

2. The fuel supply system in accordance with claim 1, wherein said fuel reservoir comprises a vapor separator.

3. The fuel supply system in accordance with claim 1, wherein said means for limiting comprises means for limiting a change in fuel level in said reservoir when said position of said motor changes.

4. The fuel supply system in accordance with claim 3, wherein said means for limiting a change in fuel level comprises at least one baffle positioned in said reservoir.

5. The fuel supply system in accordance with claim 1, wherein said valve means comprises a float operated valve controlling a fuel inlet to said reservoir and said means for limiting comprises arranging said reservoir such that a fuel level therein generally passes through a center of gravity of said float regardless of a position of said motor.

6. The fuel supply system in accordance with claim 1, wherein said means for limiting comprises means for limiting a change in a sensed fuel flow rate when said motor position is changed from a sensed flow rate before said motor position is changed.

7. The fuel supply system in accordance with claim 6, wherein said means for limiting a change prevents said sensed flow rate from increasing more than about twenty percent above said sensed flow rate before said motor position is changed.

8. The fuel supply system in accordance with claim 6, wherein said means for limiting a change prevents said sensed flow rate from decreasing more than about twenty five percent below said sensed flow rate before said motor position is changed.

9. The fuel supply system in accordance with claim 1, wherein said fuel flow rate detection means detects a fuel flow rate in a first mode at spaced first intervals, and in a second mode at second spaced intervals which are larger than said first intervals, said second mode employed when said motor position changes.

10. The fuel supply system in accordance with claim 1, further including a lubricating system delivering lubricating oil to said reservoir for mixing with said fuel therein and delivery to said charge former.

11. A fuel supply system for an engine powering an outboard motor, said motor pivotally connected to a watercraft about a generally horizontal axis and moveable between a trimmed up and trimmed down position, said motor including a water propulsion device and a cowling in which said engine is positioned, said engine having an output shaft arranged to drive said water propulsion device, said fuel supply system including means for delivering fuel from a fuel supply to a reservoir positioned within said cowling, means for controlling a flow of fuel into said reservoir based upon a fuel level within said reservoir, means for sensing the flow rate of fuel into said reservoir and controlling said means for delivering based upon a sensed flow rate, and means for limiting a change in sensed flow rate caused by a change in trim position of said motor.

12. The fuel supply system in accordance with claim 11, wherein said means for limiting limits movement of fuel within said reservoir.

13. The fuel supply system in accordance with claim 12, wherein said means for limiting comprises at least one baffle.

14. The fuel supply system in accordance with claim 11, wherein said means for controlling comprises a float actuated valve and said means for limiting comprises arranging said reservoir such that a fuel level within said reservoir generally passes through a center of gravity of said float regardless of said trim position of said motor.

15. The fuel supply system in accordance with claim 11, wherein said means for limiting comprises means for preventing a change in sensed flow rate beyond a predetermined level from a sensed flow rate before a change in motor trim position.

16. The fuel supply system in accordance with claim 11, wherein said means for limiting comprises means for increasing a sensing interval of said means for sensing when a trim position of said motor is changed.

* * * * *